United States Patent [19]

Krieg et al.

[11] 4,265,556

[45] May 5, 1981

[54] APPARATUS FOR SETTING PROPORTIONAL MARGINS BASED UPON THE WIDTH OF A SCANNED SHEET OF PAPER

[75] Inventors: Michael L. Krieg; Paul A. Quinn, Jr., both of Lexington, Ky.

[73] Assignee: International Business Machines Corporation, Armonk, N.Y.

[21] Appl. No.: 971,982

[22] Filed: Dec. 21, 1978

[51] Int. Cl.[3] ..... B41J 21/02

[52] U.S. Cl. ..... 400/342; 400/279; 400/320; 400/705.1; 400/708

[58] Field of Search ..... 400/2, 126, 279, 282, 400/320, 342, 703, 705, 705.1, 705.5, 708, 708.1; 346/75; 355/3 R; 250/237 G

[56] References Cited

U.S. PATENT DOCUMENTS

| | | | |
|---|---|---|---|
| 3,020,996 | 2/1962 | D'Onofrio | 400/282 X |
| 3,785,471 | 1/1974 | Dodds | 400/705.5 X |
| 3,809,472 | 5/1974 | Liechty | 355/3 R |
| 3,831,728 | 8/1974 | Woods et al. | 400/126 X |
| 4,152,083 | 5/1979 | Kostoff | 400/342 |
| 4,180,703 | 12/1979 | Cialone et al. | 250/237 G |
| 4,180,704 | 12/1979 | Pettit | 250/237 G |

FOREIGN PATENT DOCUMENTS

| | | | |
|---|---|---|---|
| 2749976 | 5/1978 | Fed. Rep. of Germany | 400/320 |
| 2705282 | 8/1978 | Fed. Rep. of Germany | 400/282 |

OTHER PUBLICATIONS

IBM Technical Disclosure Bulletin, "Paper Edge Sensing", Smith, vol. 20, No. 3, Aug. 1977, p. 904.

IBM Technical Disclosure Bulletin, "Right Hand Margin Set and Print Inhibit", Wipke, vol. 20, No. 10, Mar. 1978, pp. 3996-3997.

IBM Technical Disclosure Bulletin, "Side-Of-Forms, End-Of-Forms, and Forms Jam-Detection Scheme for Printers", Brown et al., vol. 20, No. 11A, Apr. 1978, pp. 4266-4269.

*Primary Examiner*—Ernest T. Wright, Jr.

*Attorney, Agent, or Firm*—William J. Dick; Kenneth W. Hairston

[57] ABSTRACT

In a typewriter environment, a carrier mounted sensor for calculating the width of a sheet of paper on the platen and for thereafter setting-up proportional margins for that sheet of paper. In addition to supporting the sensor, the carrier supports the printhead and associated apparatus for detecting the position of the carrier relative to the platen at each escapement position of the carrier. The sensor starts its scan at the extreme left position of the carrier and senses the left edge of the paper at a transition from dark (the platen surface)-to-light (the sheet of paper). This transition point is detected and stored. The carrier continues its rightward scan and the right edge of the sheet of paper signals a transition from light-to-dark. This position is detected and stored. The carrier and sensor continue scanning to the right for a specific distance to eliminate errors that are caused by dark areas on the paper that prematurely trigger light-to-dark transitions. At the end of the scan, the recorded distances yield the width of the sheet of paper and from this recorded width margins equal to a certain proportion of the total recorded width of the sheet of paper are set.

15 Claims, 11 Drawing Figures

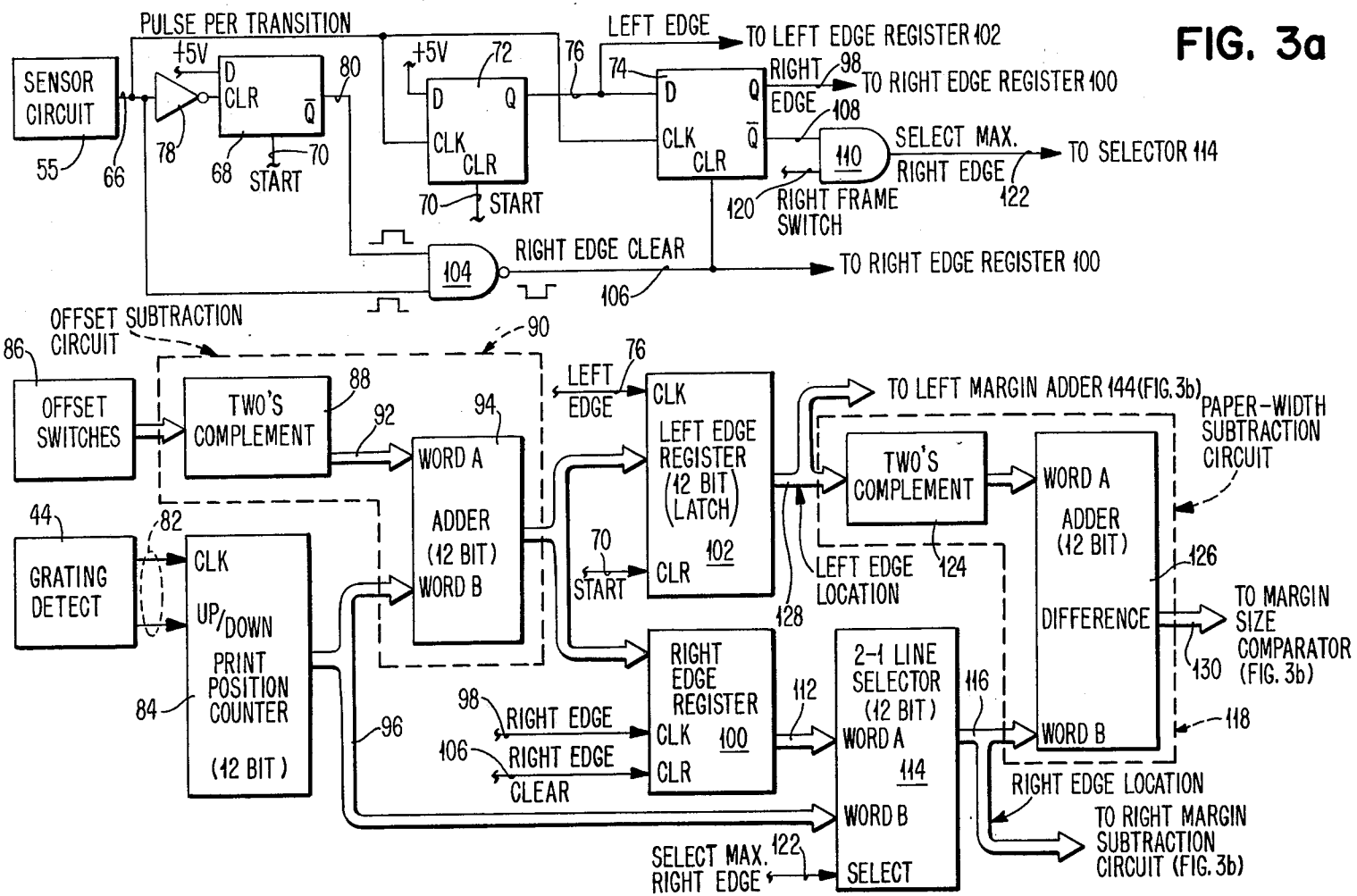
FIG. 3a
SENSOR CIRCUIT
55
PULSE PER TRANSITION
+5V
66
78
68
80
70
START
D
CLR
Q
72
+5V
D
CLK
CLR
Q
START
70
76
LEFT EDGE
74
D
CLK
CLR
Q
TO LEFT EDGE REGISTER 102
RIGHT EDGE
98
TO RIGHT EDGE REGISTER 100
108
110
RIGHT FRAME SWITCH
120
SELECT MAX. RIGHT EDGE
122
TO SELECTOR 114
TO RIGHT EDGE REGISTER 100
RIGHT EDGE CLEAR
106
104
OFFSET SUBTRACTION CIRCUIT
90
OFFSET SWITCHES
86
TWO'S COMPLEMENT
88
92
WORD A
ADDER (12 BIT)
WORD B
94
GRATING DETECT
44
82
CLK
UP/DOWN
PRINT POSITION COUNTER
(12 BIT)
84
96
LEFT EDGE
76
CLK
LEFT EDGE REGISTER (12 BIT) (LATCH)
102
CLR
70
START
128
LEFT EDGE LOCATION
TWO'S COMPLEMENT
124
TO LEFT MARGIN ADDER 144 (FIG. 3b)
PAPER-WIDTH SUBTRACTION CIRCUIT
126
WORD A
ADDER (12 BIT)
DIFFERENCE
WORD B
TO MARGIN SIZE COMPARATOR (FIG. 3b)
130
118
RIGHT EDGE LOCATION
TO RIGHT MARGIN SUBTRACTION CIRCUIT (FIG. 3b)
RIGHT EDGE
98
RIGHT EDGE
CLEAR
106
RIGHT EDGE REGISTER
100
CLK
CLR
112
2-1 LINE SELECTOR (12 BIT)
114
WORD A
WORD B
SELECT
116
SELECT MAX. RIGHT EDGE
122

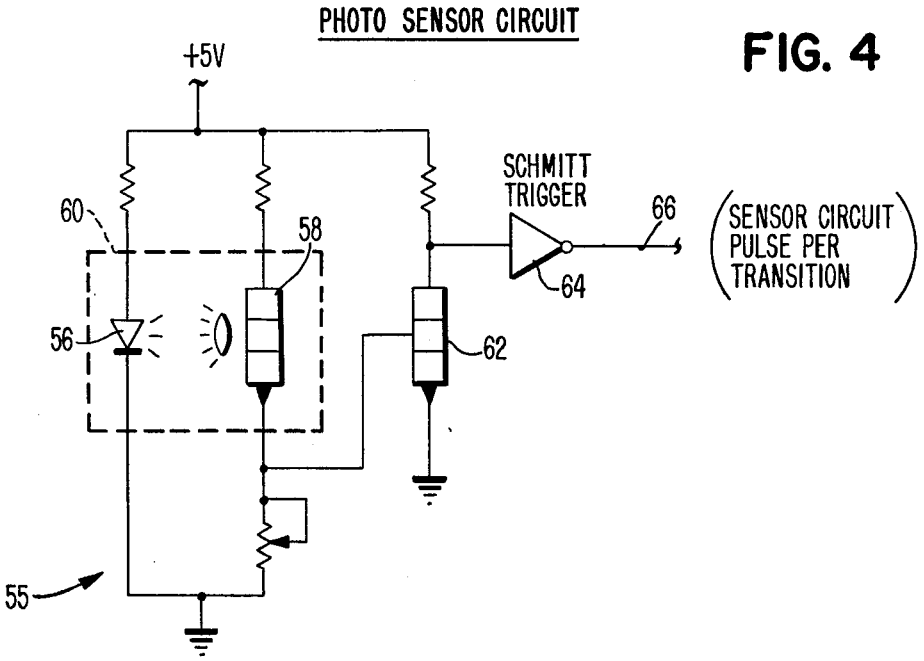
FIG. 4
FIG. 8
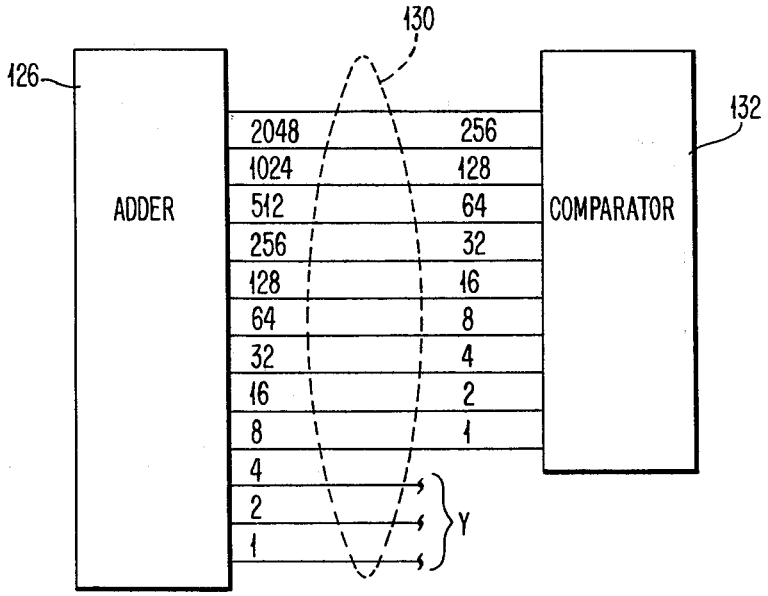

APPARATUS FOR SETTING PROPORTIONAL MARGINS BASED UPON THE WIDTH OF A SCANNED SHEET OF PAPER

The invention in this application is related to the invention contained in patent application Ser. No. 972,100 filed on Dec. 21, 1978, inventors P. A. Quinn, Jr., et al and entitled "Automatic Margin Setting Apparatus For A Scanned Sheet of Paper", and assigned to the assignee of the present application.

BACKGROUND OF THE INVENTION

I. Field of the Invention

This invention relates to a mechanism for determining the margins for a sheet of paper in a typewriter, and more particularly to a carrier mounted sensor and associated apparatus for determining the width of the sheet of paper and for calculating margins that are equal to a predetermined proportion of the total sensed width of the sheet of paper.

II. Prior Art

Heretofore, the setting of margins for a sheet of paper has been left almost entirely to the skill and judgement of the typist. For standard size paper, this does not present a problem. However, if variable widths of paper are used, margins as numerous as the sheet widths may result.

In the prior art there are teachings of preprogrammed margins and tab racks. For example, U.S. Pat. No. 3,020,996 discloses an optical sensing mechanism for sensing marks on the sheet to control tab position settings. This patent further provides for mechanically settable margins. U.S. Pat. No. 3,785,471 teaches the automatic setting of left and right margins in accordance with the position of a center point indicator so that the margin stops are positioned by movement of the pointer to correspond to the margins required for a particular letter size (e.g., the number of words in the letter). While a form of sensing is disclosed by one reference and the teaching of automatic margin setting is disclosed in another, sheet width sensing and automatic margin setting in accordance with this sensed width is not disclosed in the prior art.

It is known in the prior art to utilize the sensed size of a sheet to control machine function. Exemplary of patents teaching this type of application is U.S. Pat. No. 3,809,472 which discloses a xerographic device in which the size of sheet being transported through a xerographic copier is sensed in order to control the exposure given the side portions of a photoconductive drum. In effect, the photoconductive drum is charged by an amount determined by the width of the sheet to be utilized in the copy machine.

Again, none of the prior art teaches the concept of sensing the sheet width in order to automatically control the setting of proportional margins in a typewriter mechanism.

OBJECTS OF THE INVENTION

It is an object of this invention to uniformly and automatically set sheet margin widths.

It is another object of this invention to automatically set individual sheet margins based upon the total sensed width of a sheet of paper.

It is still another object of this invention to automatically set margins equal to a predetermined proportion of the total sensed width of a sheet of paper.

SUMMARY OF THE INVENTION

The above objects are accomplished through the use of a carrier mounted sensor that senses dark-to-light and light-to-dark transitions between the platen and the sheet of paper held thereto. The carrier mounted sensor starts a scan at the left edge of the platen. Assuming that the platen is darker in color than the sheet of paper, the sensor detects a transition from dark-to-light at the left edge of the sheet of paper and a light-to-dark transition at the right edge of the sheet. The scan continues past the light-to-dark transition to compensate for premature transition signals caused by dark areas on the light sheet of paper. The distance between these two transitions corresponds to the width of the sheet of paper.

After the sheet width is determined, margins equal to a predetermined proportion of the total sensed width of the sheet of paper are automatically set. The location of these margins for the sheet of paper are determined by comparing the aforementioned sensed information with information from a carrier mounted scanner that determines the location of the carrier, relative to the platen, at each step of the carrier. From this comparison, the number of counts required for the carrier in its extreme left position to reach the left edge of the paper, the right edge of the paper, as well as the two margins, are determined. The print apparatus on the carrier can now start printing.

The foregoing and other objects, features and advantages of the invention will be apparent from the following more particular description of the preferred embodiment of the invention as illustrated in the accompanying drawing.

BRIEF DESCRIPTION OF THE DRAWING

FIGS. 3*a* and 3*b* are schematic block diagrams of apparatus for providing an output indicative of both the left and right margins for a scanned sheet of paper;

FIG. 4 is a schematic diagram of circuitry for the scanner mounted on the carrier shown in FIG. 1;

FIG. 8 is a schematic diagram of a divide-by-eight circuit located between the paper-width subtraction circuit and comparator of FIGS. 3*a* and 3*b;*

BRIEF DESCRIPTION OF THE PREFERRED EMBODIMENT

Figure 1:
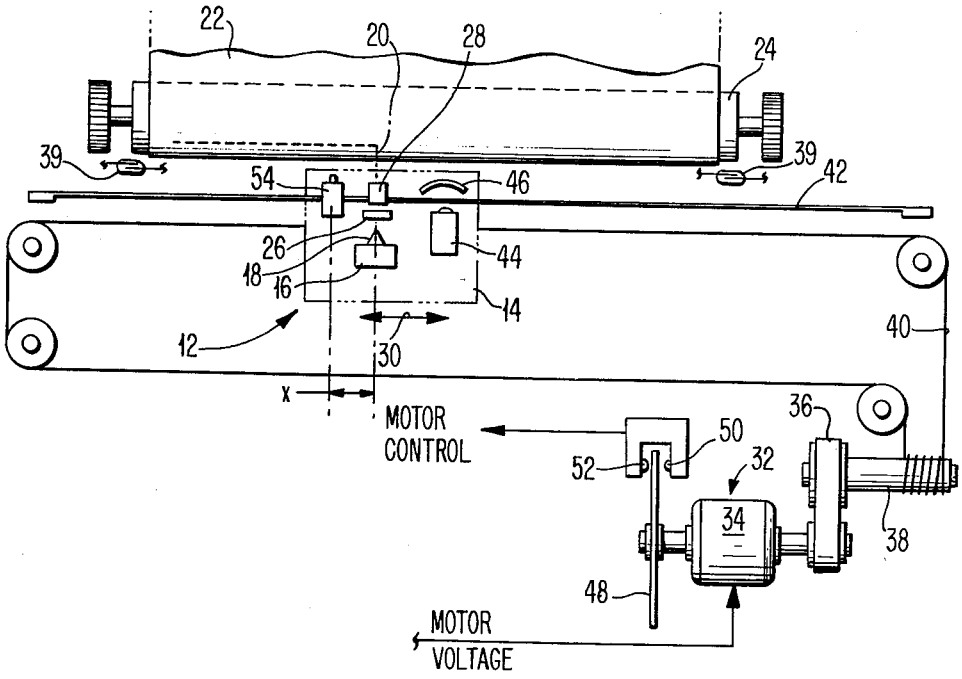
FIG. 1 diagrammatically illustrates a carrier mounted printer and scanner mechanisms constructed in accordance with the present invention.
Figure 2:
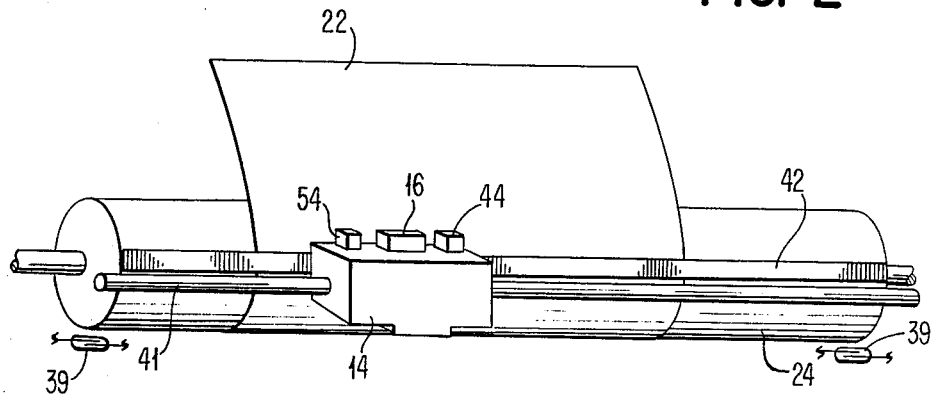
FIG. 2 is an oblique side view of the mechanism of FIG. 1.

Referring to FIGS. 1 and 2, an ink jet printer 12 is illustrated which includes, inter alia, a carrier 14 upon which printing apparatus are mounted. The printing apparatus includes an ink jet print head 16 with a nozzle 18 thereon for emitting a stream of ink 20 towards paper 22 on platen 24. The stream of ink 20 contains individual droplets formed by pressure perturbations on the stream 20 in ink jet head 16. While in flight towards platen 24, the individual drops in the stream 20 are charged by charge electrode 26 and then passed through deflection electrodes 28 before impinging upon paper 22 or other print receiving media on platen 24.

In FIGS. 1 and 2, carrier 14 is movable relative to platen 24 in the direction of arrow 30 by drive source 32. The drive source 32 includes DC motor 34 coupled in a convenient manner to carrier 14 to effect displacement of the carrier 14 relative to the print receiving media 22. As seen in FIG. 1, the DC motor 34 is connected as by a timing belt 36 or its equivalent to a cable wound drum 38 having several turns of cable 40 thereon which are connected to opposite sides of carrier 14 so that motor rotation, depending upon direction, will effect carrier motion in the direction of arrow 30. As seen in FIG. 2, a guide rod 41 supports and guides carrier 14 in its movement along the length of platen 24. A pair of reed switches 39 are provided at both ends of platen 24 which are activated when ink jet print head 16 on carrier 14 passes thereby.

In order to insure that the location of the carrier 14 is correct relative to start of print and that the direction of movement of the carrier 14 relative to paper 22 is correct, means is provided for locating the carrier 14 at any time during its movement in the direction of arrow 30. To accomplish this a grating strip 42 is employed in conjunction with a light emitting and detection module 44 (grating strip scanner), including a mirror 46, to permit both a position indicating control for the carrier 14 and a direction of movement control for carrier 14. A more complete explanation for the grating strip and its associated scanner is illustrated and described in patent applications Ser. No. 920,305 filed on June 28, 1978, inventors D. R. Cialone et al, now U.S. Pat. No. 4,180,703, issued Dec. 25, 1979 and entitled "Bi-Directional Self Imaging Grating Detection Apparatus" and Ser. No. 920,306, filed also on June 28, 1978, inventor J. W. Pettit, now U.S. Pat. No. 4,180,704, issued Dec. 25, 1979 and entitled "Detection Circuit for A Bi-Directional Self Imaging Grating Detection Apparatus", both applications being assigned to the assignee of the present application and both patents being herein incorporated by reference.

To find the velocity of motor 34, a plurality of slots, adjacent the periphery of emitter wheel 48 on motor 34, pass between an encoder comprised of a light emitting diode 50 or its equivalent and a phototransistor 52 so that a pulse is emitted by the phototransistor 52 upon the passage of a slot between the light emitting diode 50 and the phototransistor 52. The signal information derived is processed in circuitry (not shown) to arrive at a control voltage for motor 34. A more complete explanation of such circuitry is found in patent application Ser. No. 954,374, filed on Oct. 24, 1978, inventors D. B. Morgan et al and entitled "Printer Escapement Control System", assigned to the assignee of the present application and incorporated herein by reference.

The paper scanner 54 of this invention is also conveniently located on carrier 14. As seen in FIGS. 1 and 2, paper scanner 54 is mounted on carrier 14 opposite grating strip scanner 44. Scanner 54 traverses the length of paper 22 and platen 24 during a scan operation. Any conventional scanner capable of distinguishing between dark and light areas and registering changes between the two can be used as a scanner 54. FIG. 4 sets forth apparatus and circuitry 55 for a scanner meeting the specifications of scanner 54. This scanner 54 includes an LED 56 or a similar light emitting device and a phototransistor 58 connected to form a Darlington pair 60. In operation, phototransistor 58 senses any change in the radiant energy from LED 56 reflected off of either paper 22 or platen 24 (depending upon the location of carrier 14 and the size of the paper 22 on the platen 24). A change occurs whenever there is a transition from dark-to-light (platen 24 to paper 22) or light-to-dark (paper 22 to platen 24). A current signal is generated which is thereafter converted by transistor 62 to a voltage appropriate to be applied to Schmitt trigger 64. The digital output on line 66 from Schmitt trigger 64, in the form of a pulse per transition (as stated above), is applied to latch 68 shown in FIG. 3*a*.

A start signal enters latches 68 and 72 over line 70 when carrier 14 begins its travel along the length of platen 24. At this time, scanner 54 is scanning along the dark area of platen 24. The first transition is a dark-to-light transition that occurs when the scanner 54 encounters the extreme left edge of paper 22. Sensor circuit 55 produces a pulse at every transition over line 66 to latches 68, 72 and 74.

As stated, a start signal enters latches 68 and 72 over line 70 when carrier 14 begins its travel along the length of platen 24. (This signal can be seen at point 200 on the timing diagram of FIG. 5). At this time, paper scanner 54 is scanning along the dark area of platen 24. The first transition will be a dark-to-light transition that occurs when the scanner 54 encounters the extreme left edge of paper 22. The paper scanner circuitry 55 produces a pulse at every transition over line 66 to latches 68, 72 and 74. When the left edge of paper 22 is sensed, the positive edge of the transition signal on line 66, in FIG. 3*a*, triggers latches 72 and 74. A left edge output pulse to this effect outputs latch 72 over a line 76 to latch 74 and to a register 102 to be discussed further hereinafter.

The inverter 78 is located between paper scanner circuit 55 and latch 68 so that the trailing edge of a transition pulse will trigger latch 68 to cause a completion of light-to-dark pulse to appear on line 80. The function of this pulse on line 80 will be discussed more fully hereinafter.

As stated previously, grating strip scanner 44 detects the position of the carrier 14 at every step or position of the carrier 14 and outputs this information over lines 82 to print position counter 84 as seen in FIG. 3*a*. Consequently, the position along the grating strip 42, corresponding to the location at which the left edge of the sheet of paper 22 was detected on platen 24, is recorded.

Figure 3B:
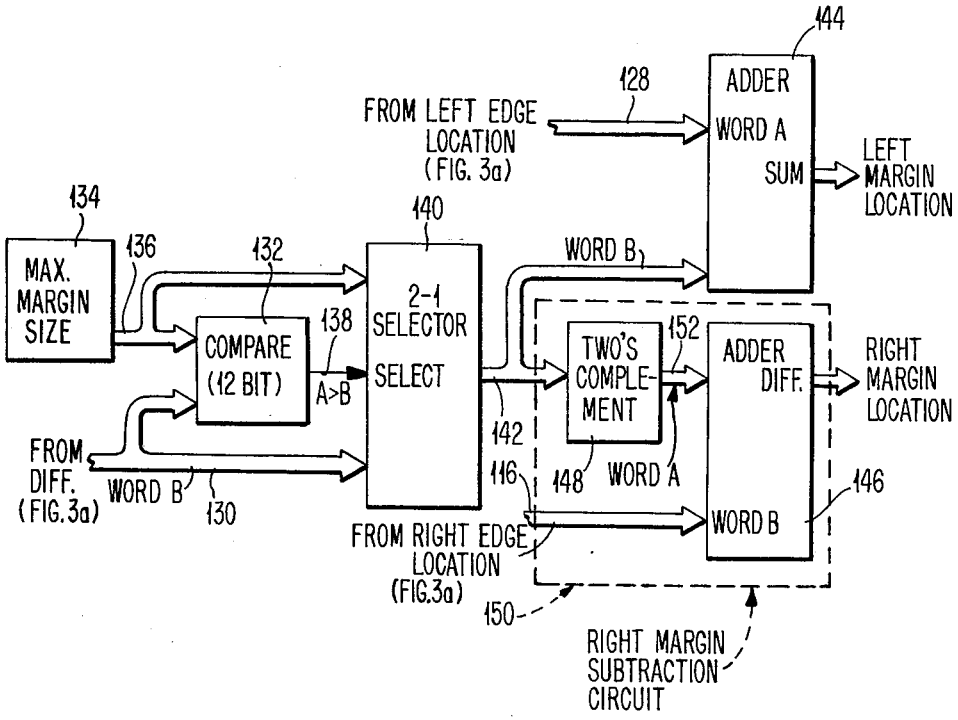
Figure 6:
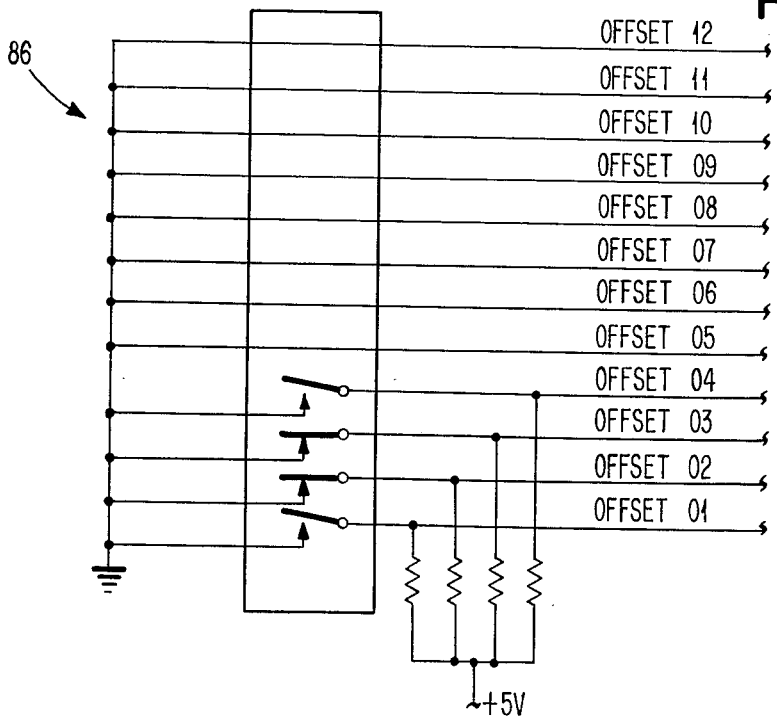
FIG. 6 is a schematic diagram of switching circuitry for the offset switching block illustrated schematically in FIG. 3*a;*
Figure 7:
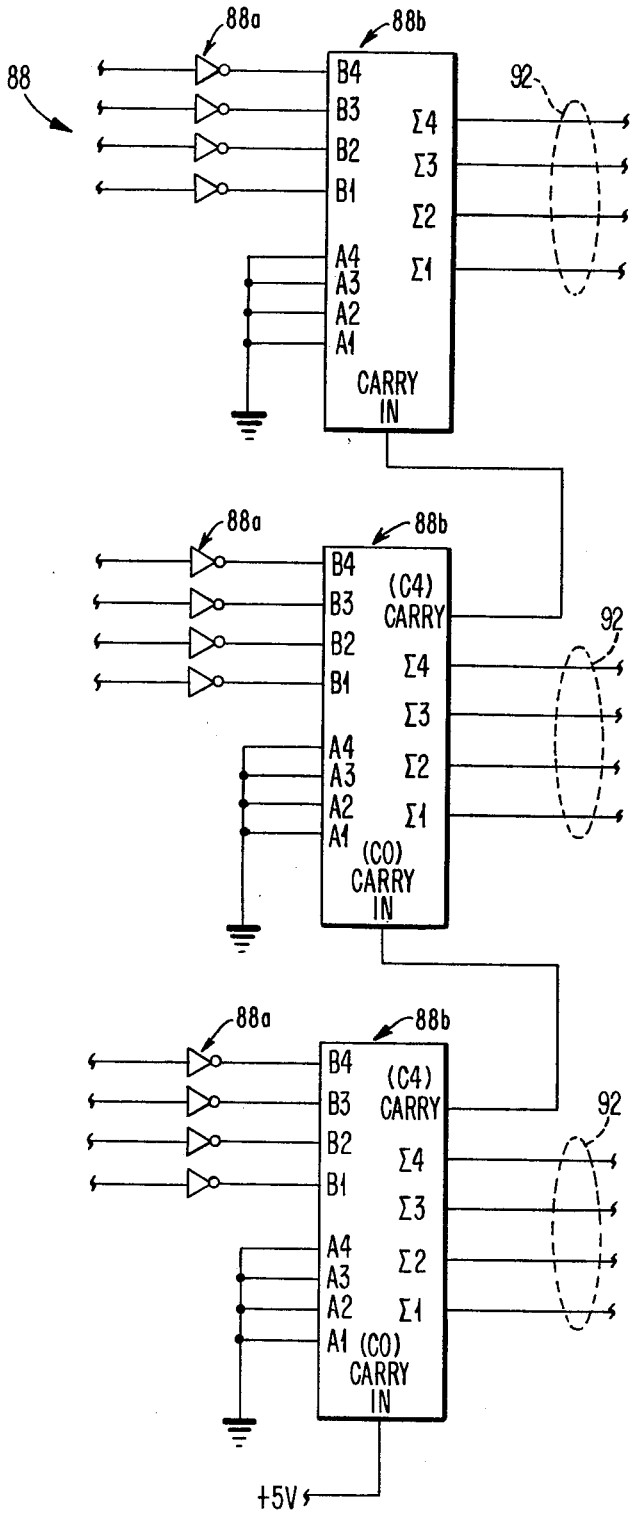
FIG. 7 illustrates logic circuitry for the two's complement boxes illustrated schematically in FIG. 3*a;*

When paper scanner 54 first encounters the left edge of paper 22, ink jet printhead 16 is a distance (x) away from the left edge of paper 22. To compensate for this offset distance, a set of offset switches 86, shown in FIGS. 3*a* and 6, are used to compensate for this offset distance (x) between scanner 54 and ink jet printhead 16. The offset switches 86 shown in FIG. 6 are standard switches programmed to compensate for the distance (x). For purposes of illustration, the offset distance (x) between ink jet printhead 16 and paper scanner 54 is a distance of 9 individual counts on grating strip 42. As a result of the offset switch circuitry 86, in FIG. 6, ink jet printhead 16 will appear to the logic in FIGS. 3*a* and 3*b* to be at the left edge of paper 22 even though it is 9 individual grating counts to the right of the left edge of paper 22 at that particular time. This offset compensation count from offset switches 86, in FIG. 6, outputs to two's complement circuit 88 which is part of offset subtraction circuit 90. An example of a two's complement 12 bit binary circuit 88 is set forth in FIG. 7. This two's complement circuit 88 is comprised of a series of inverters 88*a* and adders 88*b*. When a binary word enters the inverters 88*a* of two's complement circuitry 88, it is inverted and a one is added to it and this inverted word is rippled through the series of adders 88*b* to yield the two's complement sum of the word. The two's complement output on line 92 goes to adder 94 of offset subtraction circuitry 90 where it is subtracted from the print position counter information from counter 84 which inputs adder 94 over line 96. This subtraction operation is carried out because grating detector 44 is detecting the position of ink jet printhead 16 relative to the platen 24 at each count and not the position of paper scanner 54 at each count along grating strip 42. The subtraction operation yields the true position of the left edge of paper 22 with respect to printhead 16.

As scanning continues along the width of paper 22, a false right paper edge pulse will be generated by latch 74 on line 98, which inputs right edge register 100, if a dark area (e.g., preprinted letterhead) on paper 22 is scanned by paper scanner 54. A false light-to-dark transition pulse will be generated on line 66 that will cause latch 74 and other logic in FIG. 3*a* to believe that the right end of paper 22 has been sensed. On the timing diagram of FIG. 5, the light-to-dark transition pulse can be seen at point 202 on the transition line. In this same timing diagram, it can be seen that a left edge pulse 204 was generated when the dark-to-light transition pulse 206 occurred. Likewise, a right edge pulse 208, even though a false one, is formed when the light-to-dark pulse 202 is generated by paper scanner circuit 55. At the completion of the light-to-dark pulse from paper scanner circuit 55, the latch 68 will register a completion of light-to-dark pulse over line 80 to gate 104. This completion of light-to-dark pulse can be seen on the timing diagram of FIG. 5 at point 210 on the completion line.

As the paper scanner 54 continues its sweep across paper 22 and leaves the aforementioned dark area on paper 22, if another light area on paper 22 is sensed, a dark-to-light transition pulse from the paper scanner circuit 55 will be generated (as seen at point 212 in FIG. 5) over line 66 to gate 104. This high pulse combined with the other high pulse (false completion of light-to-dark pulse) from latch 68 in gate 104 will cause a low pulse on line 106 which is a right edge clear signal for both latch 74 and right edge register 100. Consequently, this dark-to-light transition pulse tells the system and associated logic that the prior light-to-dark transition signal (which would correspond to the right edge of paper 22) was a false one and to ready itself for another light-to-dark transition signal. This false value is cleared or erased from both latch 74 and right edge register 100 by this right edge clear signal on line 106.

Figure 5:
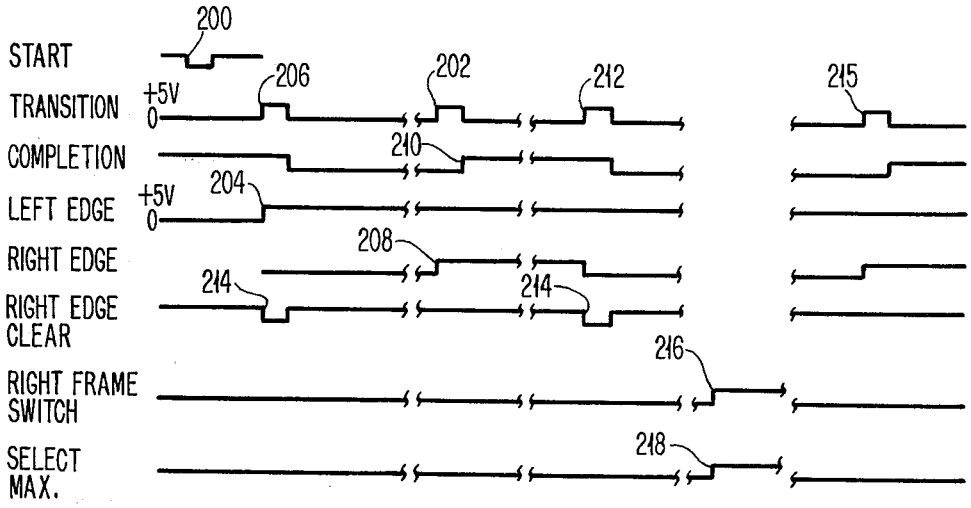
FIG. 5 is a timing diagram related to the margin setting apparatus of FIGS. 3*a* and 3*b;*

As seen in the timing diagram of FIG. 5, a right edge clear signal 214 occurs whenever a dark-to-light transition occurs (e.g., when the paper scanner 54 first encounters the left edge of paper 22 and after writing on the paper 22 has triggered a false light-to-dark transition pulse).

The output 108 from latch 74 that inputs gate 110 remains high until the right edge of paper 22 is detected. Whenever the right edge of paper 22 is detected, an output to this effect will appear on output 98 from latch 74. This output from latch 74 inputs right edge register 100. On the timing diagram of FIG. 5, whenever the right edge signal goes high or a light-to-dark transition occurs, the signal on line 108 will always be opposite to it. The left edge output pulse on line 76 from latch 72 has already inputted left edge register 102 at this time.

When the right edge of paper 22 is sensed by paper scanning circuit 55, a pulse on line 66 to latch 74 will cause a right edge signal output on line 98 which will be recorded in right edge register 100. This light-to-dark transition pulse occurs at point 215 on the transition line shown in FIG. 5. If a true right edge of paper 22 is sensed, an output 112 from right edge register 100 will input selector 114. A selector circuit suitable for use in this invention can be a Texas Instruments Quadruple 2-Line-To-1-Line Data Selector/Multiplexer, Ser. No. 74157. From selector 114, this sensed right edge value would be forwarded over line 116 to paper-width subtraction circuit 118.

If the right edge of paper 22 is not sensed by paper scanner 54 and reed switch 39 is triggered by the ink jet printhead 16 on carrier 14 when it reaches an extreme right position relative to platen 24, a right frame switch signal generated by reed switch 39 on line 120 will enter gate 110. The period at which the right frame reed switch 39 is activated is shown in FIG. 5 at 216. Since line 108 already contains a high signal, AND gate 110 will be gated and a select maximum right edge value corresponding to the highest count value determined by grating strip scanner 44, will be selected as the right edge value for paper 22. (See select maximum right edge pulse 218 in the timing diagram of FIG. 5). This value will appear on line 122 which inputs selector 114. When such a signal occurs, selector 114 will receive a counter signal over line 96, from print position counter 84, which corresponds to the position at which the right margin reed switch 39 was activated. Again, the output of selector 114 in this instance would be on line 116.

The two's complement circuit 124 and the adder circuitry 126 in paper-width subtraction circuit 118 is substantially similar to the two's complement and adder circuits 88 and 94 respectively of offset subtraction circuit 90. The stored value in left edge register 102 enters paper-width subtraction circuit 118 over line 128 and is subtracted from the selected right edge value from selector 114 which inputs paper width subtraction circuit 118 over line 116. The difference value from paper width subtraction circuit 118 corresponds to the actual sensed width of paper 22. This output is on line 130 and inputs comparator 132. As seen in FIG. 8, the three (3) lowest bits of the twelve bit signal on line 130, between adder 126 and comparator 132, are dropped to form what is known in the art as a divide-by-eight circuit. This circuit will in essence divide the paper width value by 8 or 12.5% of the width of paper 22 will be set aside for each of the margins. As a result of this, proportional margins for the sheet of paper 22 on platen 24 in FIG. 1 can be determined. It is to be recognized that other proportional margin sizes can be created by dropping different numbers of bits from the 12 bit signal appearing on line 130. For purposes of illustration, the three (3) bits, designated by (y) in FIG. 8, were dropped only to show how proportional margins for the sheet of paper 22 on the platen 24 can be found.

Figure 9:
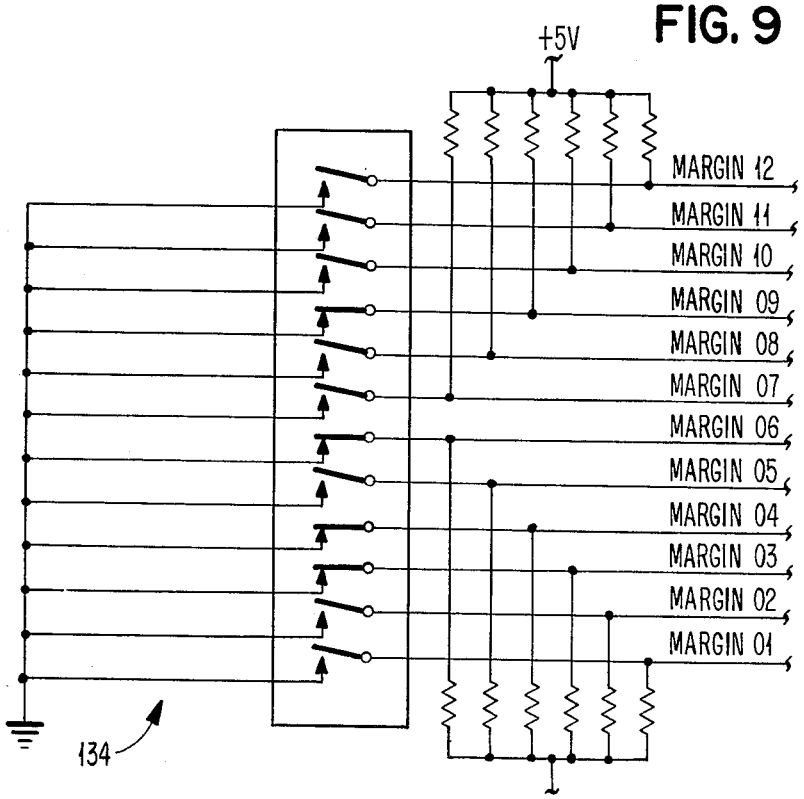
FIG. 9 is a schematic diagram of switching circuitry for the maximum margin size block illustrated schematically in FIG. 3*b.*

In FIG. 9, switch circuitry 134, corresponding to block 134 in FIG. 3*b*, is shown for determining a maximum margin size for the paper 22. As the width of the paper 22 increases and reaches a maximum value, it is not feasible to correspondingly increase the size of the margins. Therefore, a desired maximum margin size is programmed by the switches 134 shown in FIG. 9. (The series of switches 134 shown are standard TTL switches). For purposes of illustration, the value programmed into maximum margin size switches 134 has been set to a decimal count of 300 or 30.0 millimeters on each side of the sheet of paper 22. This value was selected assuming that each grating position count on grating strip 42, as shown in FIG. 1, represents 0.1 millimeter. Accordingly, the 12 bit up-down print position counter 84, seen in FIG. 3*a*, will allow a paper width of approximately 409.5 millimeters for the grating strip 42 and platen 24 shown in FIG. 1.

In accordance with the above-described maximum margin, a maximum margin value always appears on line 136 and inputs comparator 132. This maximum margin size value is compared in comparator 132 with the proportional margin size that enters comparator 132 over line 130. If the proportional margin size is less than the maximum margin size, comparator 132 outputs a command signal over line 138 to selector 140 to command selector 140 to accept the proportional margin value on line 130. If the proportional margin value exceeds the maximum margin value, comparator 132 will command selector 140 over line 138 to accept the maximum margin size value on line 136. (The selector 140 is substantially similar to the previously described selector 114). Whichever margin size selector 140 accepts, its output will be on line 142.

The output margin value on line 142 inputs adder 144 and is combined therein with the sensed left paper edge value on line 128. The combination of these two values will yield, at the output of adder 144, the actual location of the left margin for the particular piece of paper 22 on platen 24.

In order to determine the right margin value, the right edge value of the paper 22 on line 116 from selector 114 inputs adder 146 where it is combined with the margin value on line 142 from selector 140. Before these two values are combined, the value on line 142 goes through two's complement circuit 148. Adder 146 and two's complement circuit 148 form a right-margin subtraction circuit 150 that is substantially similar to the offset subtraction circuit 90. In essence, the output value on line 152 from two's complement circuit 148 becomes a difference value to the right margin value when they are combined in adder 146. The output of adder 146 is the location of the right margin for paper 22.

While the invention has been shown and described with reference to a preferred embodiment thereof, it will be appreciated by those having skill in the art that variations in form and detail may be made therein without departing from the spirit and scope of the invention.

What is claimed is:

1. An automatic proportional margin setting apparatus for a typewriter including:

a platen for supporting a sheet of paper thereon;

a carrier mounted for relative movement with respect to said platen in a substantially parallel path;

printing means mounted on said carrier for printing indicia on the sheet of paper supported on said platen;

sensing means mounted on said carrier for defining the location of the left and right edges of the sheet of paper supported on said platen;

means responsive to the defined location of the left and right edges of said sheet of paper for determining the width of said sheet of paper;

margin setting means for defining margin locations in accordance with the defined edge locations and in accordance with a predetermined proportional distance; said margin setting means comprising means for establishing a fraction of said width as said proportional distance of said width, and means for combining said proportional distance with said right and left edge locations for determining the margin locations.

2. The automatic proportional margin setting apparatus of claim 1 wherein said sensing means is comprised of an optical paper scanner for detecting the location of the left and right edges of the sheet of paper supported on said platen and further comprising:

a grating with grating indicia thereon corresponding to every print position along the length of said platen;

a grating strip scanner for detecting the location of said printing means relative to said platen at every print position, said margin setting means including means for locating said margin in setting proportional margins for the sheet of paper supported on said platen by locating the position of said paper sheet edges relative to said carrier.

3. The automatic proportional margin setting apparatus of claim 2 including drive means for driving said carrier in said path wherein said optical paper scanner traverses the length of said platen and the sheet of paper supported thereon and senses transitions between said platen and the sheet of paper to define the locations of the left and right edges of the sheet of paper.

4. The automatic proportional margin setting apparatus of claim 3 wherein said optical paper scanner includes circuit means for providing pulse output upon the transitions occurring between said platen and the sheet of paper supported thereon.

5. The automatic proportional margin setting apparatus of claim 4 further including at least two latches being triggered by a pulse from said optical paper scanner at every transition between said platen and the sheet of paper, and at least two registers for storing the transition information output from said two latches; the transition information corresponding to the locations of the left and right edges of the sheet of paper.

6. The automatic proportional margin setting apparatus of claim 5 further including a third latch means and a gate means for clearing the latch of said at least two latches and the register of said at least two registers, said cleared register being the register that records and stores the transition information pertaining to the location of the right edge of the sheet of paper when a transition is detected and said cleared latch being the latch that is triggered by dark material on the sheet of paper and not by the platen at the right edge of the sheet of paper.

7. The automatic proportional margin setting apparatus of claim 5 further including right edge switch means located at the extreme right end of said platen said switch means being activated when said carrier reaches an extreme right position and the location of the right edge of the sheet of paper is not detected by said paper scanner; said switch means, when activated, providing a signal output indicating that the location of the right edge switch means is the location of the right edge of the sheet of paper.

8. The automatic proportional margin setting apparatus of claim 1 wherein said means for determining the width of said sheet of paper includes means for subtracting the defined location corresponding to the left edge of the sheet of paper from the defined location corresponding to the right edge of the sheet of paper to yield the width of the sheet of paper.

9. The automatic proportional margin setting apparatus of claim 8 wherein said means for subtracting comprises a two's complement circuit and an adder.

10. The automatic proportional margin setting apparatus of claim 8 wherein said margin setting means further includes a programmable means for taking a predetermined proportion of the width of the sheet of paper for use as margins.

11. The automatic proportional margin setting apparatus of claim 10 wherein said programmable proportional margin setting means is a divide-by-eight circuit.

12. The automatic proportional margin setting apparatus of claim 10 further including a maximum margin setting means for setting a maximum limit on the width of margins for the sheet of paper.

13. The automatic proportional margin setting apparatus of claim 12 wherein said means for establishing a fraction of said width includes comparator means for comparing the margin value from said programmable proportional margin setting means with the margin value from said maximum margin setting means and for accepting the margin value having the smallest width as the margin width for the sheet of paper.

14. The automatic proportional margin setting apparatus of claim 13 wherein said means for combining said proportional distance with said right and left edge locations includes means for adding the margin width to the location of the left edge of the sheet of paper and means for subtracting the margin width from the location of the right edge of the sheet of paper to yield both the left and right margins for the sheet of paper.

15. An automatic proportional margin setting apparatus for a typewriter including:

a platen for supporting a sheet of paper thereon;

printing means for printing indicia on the sheet of paper supported on said platen;

sensing means for defining the location of the left and right edges of said sheet of paper supported on said platen; said sensing means including a first scanner for detecting the location of said printing means at every print position and a second scanner for sensing the location of the left and right edges of said sheet of paper on said platen; said second scanner sensing transitions between said platen and the sheet of paper to locate the left and right edges of the sheet of paper;

latch means triggered by every transition between said platen and the sheet of paper;

means for storing the transition information from said latch means;

means for subtracting the transition information corresponding to the left edge of the sheet of paper from the transition information corresponding to the right edge of the sheet of paper to yield the width of the sheet of paper;

programmable proportional margin setting means for determining a predetermined proportion of the width of the sheet of paper for use as margins; and means for adding the predetermined proportional margin width to the location of the left edge of the sheet of paper and means for subtracting the predetermined proportional margin width from the location of the right edge of the sheet of paper to yield both the left and right margins for the sheet of paper.

* * * * *